US005611724A

United States Patent [19]

deGraaff

[11] Patent Number: 5,611,724

[45] Date of Patent: Mar. 18, 1997

[54] GRINDING WHEEL HAVING DEAD END GROOVES AND METHOD FOR GRINDING THEREWITH

[75] Inventor: Willem T. deGraaff, Albuquerque, N.M.

[73] Assignee: General Electric Company, Cincinnati, Ohio

[21] Appl. No.: 564,689

[22] Filed: Dec. 1, 1995

[51] Int. Cl.[6] ..... B24B 1/00

[52] U.S. Cl. ..... 451/53; 451/449; 451/450; 451/488; 451/541

[58] Field of Search ..... 451/488, 541, 451/449, 450; 125/15

[56] References Cited

U.S. PATENT DOCUMENTS

| | | | |
|---|---|---|---|
| 909,913 | 1/1909 | Landis . | |
| 1,736,355 | 11/1929 | Mosher . | |
| 2,049,874 | 8/1936 | Sherk . | |
| 2,635,399 | 4/1953 | West | 451/449 |
| 2,899,781 | 8/1959 | Williams | 451/450 |
| 3,579,928 | 5/1971 | Held | 451/448 |
| 3,841,034 | 10/1974 | Held . | |
| 3,916,579 | 11/1975 | Waller et al. . | |
| 4,661,064 | 4/1987 | Beltramini . | |
| 4,882,878 | 11/1989 | Benner . | |
| 5,052,154 | 10/1991 | Lehmann . | |

FOREIGN PATENT DOCUMENTS

| | | |
|---|---|---|
| 633635 | 2/1928 | France . |
| 523879 | 7/1940 | United Kingdom . |

*Primary Examiner*—Robert A. Rose
*Assistant Examiner*—George Nguyen
*Attorney, Agent, or Firm*—Andrew C. Hess; Nathan D. Herkamp

[57] ABSTRACT

A grinding wheel is provided having a wheel body and an abrasive surface layer having a plurality of dead end grooves extending rearwardly from the side of the circumference of the wheel to effectively gather and then trap coolant therein during grinding. The dead end grooves are preferably arranged in alternating right and left hand sections extending respectively from the right and left hand sides of the wheel. The dead end grooves effectively feed and trap coolant therein during cutting. The grinding wheel and related grinding method effectively reduce workpiece burning during creep feed grinding large surface areas and deep cuts, with a water base coolant.

3 Claims, 1 Drawing Sheet

GRINDING WHEEL HAVING DEAD END GROOVES AND METHOD FOR GRINDING THEREWITH

BACKGROUND OF THE INVENTION

1. Field of the Invention

The present invention relates to grinding wheels and methods for grinding, and more particularly relates to grinding wheels having an abrasive circumferential surface having grooves and methods for grinding therewith.

2. Description of the Related Art

Grinding wheels having abrasive circumferential surfaces are known, see Lehmann, U.S. Pat. No. 5,052,154, issued Oct. 1, 1991, which is incorporated herein by reference. The grooves disclosed in Lehmann are open ended on opposite ends and extend from side to side of the wheel. Conventional grooved grinding wheels typically have grooves which are either open ended on both ends of the groove thereby allowing coolant to escape therefrom during use or are closed at both ends thereby not allowing coolant to be conveyed from the sides of the wheel into the groove during use. Consequently, conventional grooved grinding wheels can experience (i) workpiece burning when (a) creep feed grinding large surface areas and (b) making deep cuts, and cause (ii) microboiling of a water base coolant resulting in loading of the wheel circumference with workpiece particles.

Accordingly, there is a need for a grooved grinding wheel which effectively feeds and traps coolant preventing burning of the workpiece and loading of the wheel with workpiece particles (metal build up along the circumference of the wheel).

SUMMARY OF THE INVENTION

A grinding wheel is provided having a wheel body and an abrasive surface layer having a plurality of dead end grooves extending rearwardly from the side of the circumference of the wheel to effectively gather and then trap coolant therein during grinding. The dead end grooves are preferably arranged in alternating (right and left hand) sections extending respectively from opposite (the right and left hand) sides of the wheel. The dead end grooves effectively feed and trap coolant therein during cutting. The grinding wheel and related grinding method effectively reduce workpiece burning during (i) creep feed grinding large surface areas and (ii) making deep cuts.

DETAILED DESCRIPTION OF THE INVENTION

Figure 2:
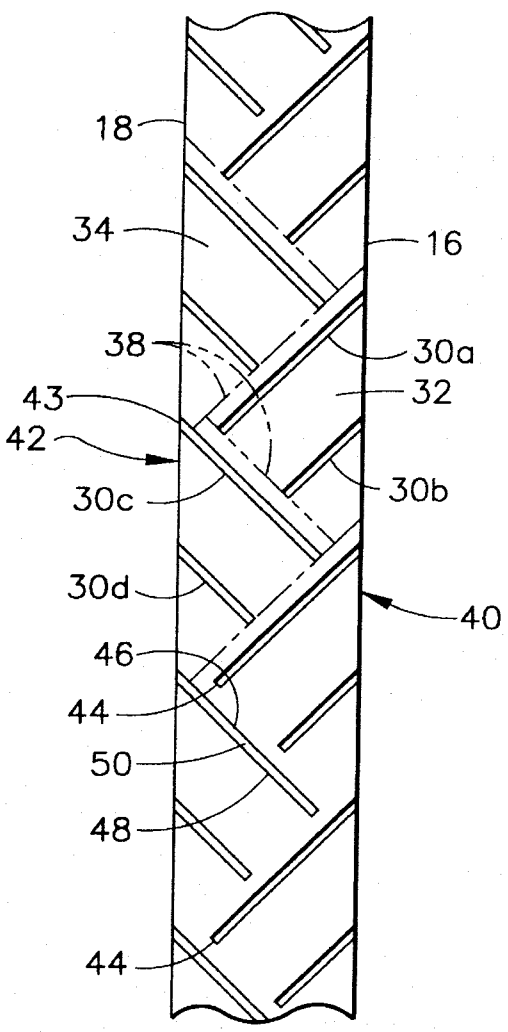
FIG. 2 is a cutaway top plan view of a grinding wheel according to the present invention.
Figure 1:
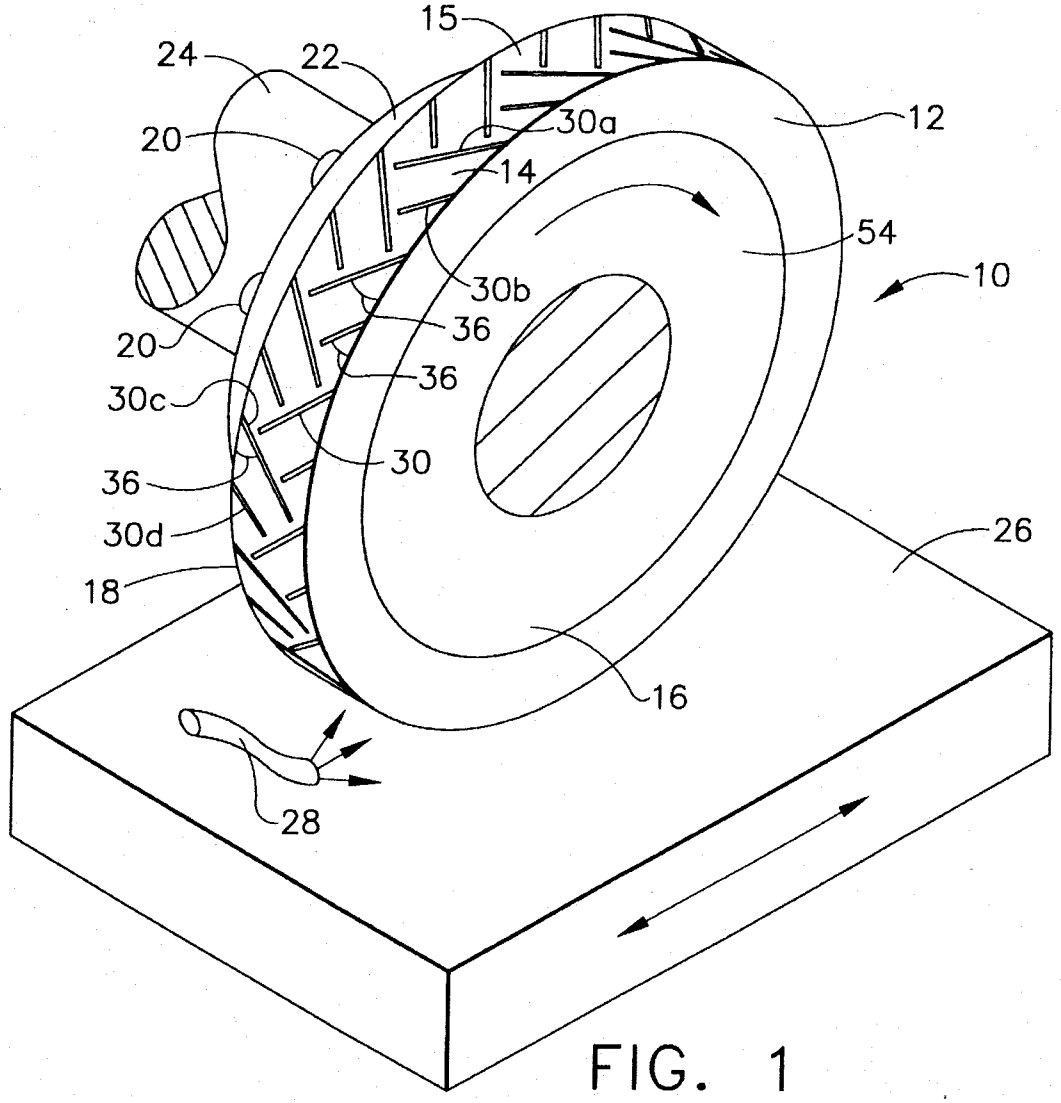
FIG. 1 is a perspective view of a grinding wheel according to the present invention.

As best shown in FIG. 1, a grinding wheel (10) includes a wheel supporting body (12) and an abrasive material layer (14) about the circumference (15) of the wheel (10) and adhered to the body (12). The wheel (10) has a left side (16) and a right side (18) (opposite sides (16, 18)). The abrasive material layer (14) is preferably from 0.2 to 8 millimeters thick and is a super-hard material such as crystalline boron nitride (cBN), or industrial diamond. The entire grinding wheel (10) may be fastened securely by bolts (20) to a flange (22) of a grinding spindle (24), coolant may be applied to a surface of a workpiece (26) by a tube (28) or to the circumference of the wheel (10) by a suitable coolant nozzle. The coolant flow is preferably in the same direction as the rotation of the wheel circumference (15).

The grooves (30) in the circumference (15) of the wheel (10) are dead end (blind) grooves (30) extending from a respective side (16, 18) of the circumference (15) in an angular fashion across a portion of the circumference (15). The dead end nature of the grooves (30) effectively feeds and traps coolant therein during grinding. The grooves (30) preferably extend from 20 to 80 percent of the distance across the circumference (15). Preferably the grooves (30) are arranged in alternating series of left hand (32) and right hand areas (sections) (34) having generally trapezoidal shapes comprising a long leading groove (**30*a*, 30*c*), a short trailing groove (30*b*, 30*d*) and optionally one or more intermediate grooves, for example, a plurality of intermediate grooves (not shown) between grooves (30*a*) and (30*b*) (and between grooves (30*c*) and (30*d*) and substantially parallel therewith having substantially the same angle (36) of extension from the respective side (16, 18). Each groove (30** *a, b, c* and *d*) of a given area (section) (32, 34) terminates along a line (38) (dashed line (38)) forming a boundary of an adjacent alternate area (section). The areas (32, 34) may also be viewed as forming a pair of intermeshing saw toothed patterns (40, 42) along, the circumference (15) of the wheel (10).

Most preferably the grooves (30) are arranged in repeating areas of (i) left hand area having short grooves (**30*a*), long grooves (30*b*), and (ii) right hand area having short grooves (30*c*) and long grooves (30*d*). The leading end (43) of each groove (30) is open to receive (feed) coolant into the groove (30) during rotation of the wheel (10). The trailing end (44) of each groove (30) terminates intermediate the circumference (15). In other words, each groove (30) does not extend across the entire width of the circumference (15). The grooves (30) each have opposing longitudinal side walls (46, 48), bottom (50) and terminal end (44). The circumference (15) preferably has a width as measured from the right side (18) to the left side (16) of between 1.0 inches and 8 inches, more preferably between 1.5 inches and 3.5 inches, and most preferably about 2.5 inches. Preferably the hub (54) of the wheel (10) has a diameter of between 3 to 10 inches, more preferably from 5 to 8 inches and most preferably about 5 inches, and preferably the wheel (10) has a diameter of between 10 and 24 inches, more preferably between 13 and 20 inches and more preferably about 14 inches, for example, 350 mm. The steel hub (54) may be recessed, and the grinding wheel may be operated at various rotational rates, for example, less than 6,000 revolutions per minute. A preferred abrasive is GE Type 500 cBN crystal having a mesh size of 60 to 80. The hub (54**) is preferably a steel hub, and the circumference of the wheel is preferably steel for a electroplated or brazed coatings and aluminum or epoxy for vitrified and resin bonded coatings.

A suitable arrangement would have 30 grooves evenly spaced around the circumference (perimeter) (15) on each side, and in more general terms 20 to 120 grooves evenly spaced around the circumference (15) on each side of the circumference (15), and more preferably from 25 to 50 grooves on each side of the circumference.

A suitable angle (36) would be from 30 to 80°, more preferably from 40 to 60° and most preferably 45°. Suitable grooves depths would be, for example, from 0.05 to 0.3 inches, more preferably, from 0.1 to 0.20 inches. Preferably groove spacing as measured from adjacent leading ends (42) on a given side (18, 20) are from 0.5 to 2.0 inches apart, and depends upon the groove angle (36).

cBN GRINDING OF T60 SHROUDS, FLOWPATH WITH PLATED, GROOVED WHEEL

| | |
|---|---|
| Depth of cut | .110" |
| Width of cut | 1.900" |
| Length of cut | 2.600" |
| Volume of cut | .5434 cu. in. |
| Wheel speed | 12,5000 SFM |
| Feed rate | 1"/min |
| Cutting time | 3 min/part |
| Workpiece material: | Superalloy such as Inco 738 |

Wheel configuration grooved pattern alternating areas of 4 grooves, short leading grooves and long trailing grooves.

The grooved profile effectively prevents workpiece burning when creep feed grinding large surface areas and deep cuts.

The coolant gets trapped inside the grooves and cannot escape (blind grooves) until the exit from the workpiece. Coolant pressure builds up between the wheel and the workpiece, preventing micro-boiling of the water based coolant and thus preventing the workpiece from heating up and the wheel from loading.

I claim:

1. A grinding wheel having a pair of first and second opposite sides comprising:

(a) a wheel supporting body having a circumferential surface, either straight or profiled, (b) an abrasive material provided at least at said circumferential surface of said body, said wheel having a first plurality of dead end grooves extending inwardly at an angle of form 30° to 80° from said first side of the circumference of the wheel, said first plurality of dead end grooves having leading ends which are open at said first side and having trailing ends which terminate intermediate the circumference of said wheel, said wheel having a second plurality of dead end grooves extending inwardly at an angle of form 30° to 80° from said second side of the circumference of the wheel, said second plurality of dead end grooves having leading ends which are open at said second side and having trailing ends which terminate intermediate the circumference of said wheel, wherein first plurality of grooves comprises a series of groove areas having sequentially longer grooves within said area.

2. The wheel of claim 1 wherein each area is substantially trapezoidal in shape having a wide forward edge, a narrow rearward edge substantially parallel with the wide forward edge, long outer edge extending along the respective side of the wheel, and an internal edge shorter than the outer edge extending along the ends of the grooves of the respective area.

3. A method for grinding comprising (a) providing a grinding wheel having an abrasive circumference, a central axis and having a plurality of dead end grooves extending form the sides of the wheel at an angle of between 30° to 80° form the sides of the wheel, wherein each of said dead end grooves has a leading end and a trailing end wherein the leading end is open and extends from a side of the circumference of the wheel to the trailing end which terminates intermediate the circumference, (b) providing a coolant in contact with said circumference, (c) grinding a superalloy workplace to make a cut therein, said grinding involving rotating the wheel about said central axis in a direction so that the open circumferential leading ends of the dead end grooves lead to the dead end trailing ends in the cutting engagement with the workpiece to trap the coolant inside the grooves in contact with the workpiece preventing the coolant from escaping the contacting grooves until the groove has been rotated past the workpiece.

* * * * *